US008813454B2

(12) United States Patent
Vermeulen et al.

(10) Patent No.: US 8,813,454 B2
(45) Date of Patent: Aug. 26, 2014

(54) PANEL COUPLING ASSEMBLY

(75) Inventors: Bruno Paul Louis Vermeulen, Aldeneik-Maaseik (BE); Jan Eddy De Rick, Geraardsbergen (BE)

(73) Assignee: Spanolux N.V.-Div. Balterio, Sint-Baafs-Vijve (BE)

( * ) Notice: Subject to any disclaimer, the term of this patent is extended or adjusted under 35 U.S.C. 154(b) by 0 days.

(21) Appl. No.: 13/704,842

(22) PCT Filed: Jun. 15, 2011

(86) PCT No.: PCT/EP2011/059946

§ 371 (c)(1),
(2), (4) Date: Feb. 27, 2013

(87) PCT Pub. No.: WO2011/157752

PCT Pub. Date: Dec. 22, 2011

(65) Prior Publication Data

US 2013/0167467 A1 Jul. 4, 2013

(30) Foreign Application Priority Data

Jun. 17, 2010 (EP) ..... 10166253

(51) Int. Cl.

| | |
|---|---|
| ***E04B 2/00*** | (2006.01) |
| ***E04F 15/02*** | (2006.01) |
| ***E04C 2/38*** | (2006.01) |
| ***E04B 5/00*** | (2006.01) |

(52) U.S. Cl.

CPC . *E04B 5/00* (2013.01); *E04F 15/02* (2013.01); *E04F 2201/0138* (2013.01); *E04F 2201/0517* (2013.01); *E04C 2/38* (2013.01)

USPC ..... 52/588.1; 52/589.1

(58) Field of Classification Search

CPC ..... E04F 2201/0115; E04F 2201/05; E04F 2201/0523; E04F 2201/0138

USPC ..... 52/588.1, 589.1, 586.1

See application file for complete search history.

(56) References Cited

U.S. PATENT DOCUMENTS

| | | | | |
|---|---|---|---|---|
| 3,731,445 | A * | 5/1973 | Hoffmann et al. | 52/391 |
| 6,763,643 | B1 * | 7/2004 | Mårtensson | 52/586.1 |
| 7,552,568 | B2 * | 6/2009 | Palsson et al. | 52/589.1 |

(Continued)

FOREIGN PATENT DOCUMENTS

| | | |
|---|---|---|
| EP | 1119671 | 9/2005 |
| FR | 2906285 | 3/2008 |

(Continued)

OTHER PUBLICATIONS

International Search Report and the Written Opinion Report of the European Patent Office Patent Office in counterpart foreign application No. PCT/EP2011/059946.

*Primary Examiner* — Basil Katcheves
(74) *Attorney, Agent, or Firm* — Steven M. Koehler; Westman, Champlin & Koehler, P.A.

(57) ABSTRACT

A panel coupling assembly includes a panel having a side edge with an activating portion. An intermediate coupling member is displaceable with respect to the panel and a base coupling and is provided with a sleeve portion facing the activating portion of the panel. A guide guides the intermediate coupling member from a non-assembled condition to an assembled condition. The guide is configured such that upon displacing the panel with respect to the base coupling member in the panel fixing direction, the activating portion of the panel presses onto the sleeve portion and the intermediate coupling member is displaced in at least a direction extending transversely to the panel fixing direction. A fixing element is engageable to the intermediate coupling member to form a locking member that couples the panel and the base coupling member.

15 Claims, 9 Drawing Sheets

(56) References Cited

U.S. PATENT DOCUMENTS

| | | | | |
|---|---|---|---|---|
| 2010/0095630 | A1* | 4/2010 | Engstrom | 52/588.1 |
| 2011/0088345 | A1* | 4/2011 | Pervan | 52/588.1 |
| 2013/0167467 | A1* | 7/2013 | Vermeulen et al. | 52/588.1 |

FOREIGN PATENT DOCUMENTS

| | | |
|---|---|---|
| WO | WO 00/20706 | 4/2000 |
| WO | WO 2004/018798 | 3/2004 |
| WO | WO 2007/142589 | 12/2007 |

* cited by examiner

PANEL COUPLING ASSEMBLY

CROSS-REFERENCE TO RELATED APPLICATION

This application is a Section 371 National Stage Application of International Application PCT/EP2011/059946 filed Jun. 15, 2011 and published as WO/2011/157752 A1 in English.

BACKGROUND

The discussion below is merely provided for general background information and is not intended to be used as an aid in determining the scope of the claimed subject matter.

Aspects of the invention relate to a panel coupling assembly.

Several types of panel coupling assemblies are known in the art. For example, EP 1 119 671 is related to a flooring system which comprises floor panels which are joined vertically by means of resilient clips.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

An aspect of the present invention includes a panel coupling assembly comprising a panel including a side edge which is provided with an activating portion directed to a panel fixing direction. A base coupling member and an intermediate coupling member are provides. The intermediate coupling member is displaceable with respect to the panel and the base coupling member in a non-assembled condition and is provided with a sleeve portion facing the activating portion of the panel. A guide for guiding the intermediate coupling member from a position in the non-assembled condition to a position in an assembled condition of the panel coupling assembly is provided. The guide is configured such that upon displacing the panel with respect to the base coupling member in the panel fixing direction the activating portion of the panel presses onto the sleeve portion and the intermediate coupling member is displaced in at least a direction extending transversely to the panel fixing direction. A fixing element is engageable to the intermediate coupling member such that in the assembled condition the intermediate coupling member and the fixing element together form a locking member that couples the panel and the base coupling member such that the panel is locked with respect to the base coupling member in a direction opposite to the panel fixing direction.

Due to the presence of the intermediate coupling member it is possible to lock the panel with respect to the base coupling member in the opposite direction of the panel fixing direction because of its displacement in transverse direction thereto. The intermediate coupling is guided to a position in the assembled condition whereas the fixing element holds the intermediate coupling member in that position with respect to the panel and the base coupling member in the assembled condition. The displacement of the intermediate coupling member in transverse direction provides the opportunity to hook it behind a wall extending transversely to the panel fixing direction, for example. It is noted that the panel may be displaceable in a transverse direction with respect to the intermediate coupling and/or the base coupling, as well, during the non-assembled condition or a part of the assembly operation.

Furthermore, the intermediate coupling member and the base coupling member may be made of plastic. The intermediate coupling member may be a rigid body. In practice it will be a separate part, which may be coupled to the base coupling member by the user or which is already coupled thereto during manufacturing.

In practice, the base coupling member may be located on the ground whereas the panel fixing direction is directed downwardly.

In one practical embodiment, the intermediate coupling member is engaged to the panel, and the fixing element is engaged to the base coupling member in the assembled condition. This means that during assembling the intermediate coupling member engages the panel whereas the fixing element forms a coupling between the intermediate coupling member and the base coupling member.

The assembly may be configured such that upon displacing the panel with respect to the base coupling member in the panel fixing direction the intermediate coupling member is displaced in the fixing direction. In this embodiment the intermediate coupling member is displaced both in the fixing direction and the direction extending transversely thereto.

The fixing element and the intermediate coupling member may comprise a snap-in connection which can be activated by displacing the panel with respect to the base coupling member beyond a predefined position.

The snap-in connection may be formed by a resilient lip at the base coupling member which engages a cam on the intermediate coupling member. This means that the fixing element is integrated in the base coupling member which minimizes the number of parts of the panel coupling assembly.

In a specific embodiment, the assembly is configured such that the activating portion of the panel and the sleeve portion of the intermediate coupling member are substantially free from each other in the assembled condition. In this case the activating portion and the sleeve portion are only used to bring the assembly from the non-assembled condition to the assembled condition, whereas other mutual contact portions of the parts are used for holding the parts of the assembly together in the assembled condition.

In one embodiment, the guide is provided at the base coupling member for guiding the intermediate coupling member with respect thereto, since this gives the base coupling member still another function.

The guide may be angled with respect to an upper face of the panel in the assembled condition. For example, the angle lies between 60 and 80 degrees.

The guide may be provided with a guide coupling, which is configured such that the intermediate coupling member is moveable with respect to the base coupling member in only one dimension. This avoids the situation that the base coupling member is pressed away from the guide during assembly, particularly in case of activating the snap-in connection.

The intermediate coupling member may be provided with a tongue extending in a direction transversely with respect to the panel fixing direction and the side edge of the panel may be provided with a groove for receiving the tongue, wherein a lower portion of the tongue forms a first intermediate coupling member contact portion which engages a first panel contact portion being a bottom portion of said groove. This can be manufactured relatively simple.

The first intermediate coupling member contact portion and the first panel contact portion may be angled with respect to an upper face of the panel. This provides the opportunity to lock the panel with respect to the base coupling member not only in a direction opposite to the panel fixing direction, but also in a direction transversely thereto. The base coupling member may be provided with a clamping portion facing the first intermediate coupling member contact portion such that a portion of the panel can be clamped between the clamping portion and the first intermediate coupling member contact portion, for example.

The assembly may comprise two integrated base coupling members, two intermediate coupling members and two panels for attaching two adjacent panels to said integrated base coupling members. The base coupling member or the integrated base coupling members can be made in one piece, for example by moulding.

BRIEF DESCRIPTION OF THE DRAWINGS

Aspects of the invention will be explained in more detail hereinafter with reference to drawings, which are schematic representations of an embodiment of the invention.

DETAILED DESCRIPTION OF THE ILLUSTRATIVE EMBODIMENTS

Figure 1:
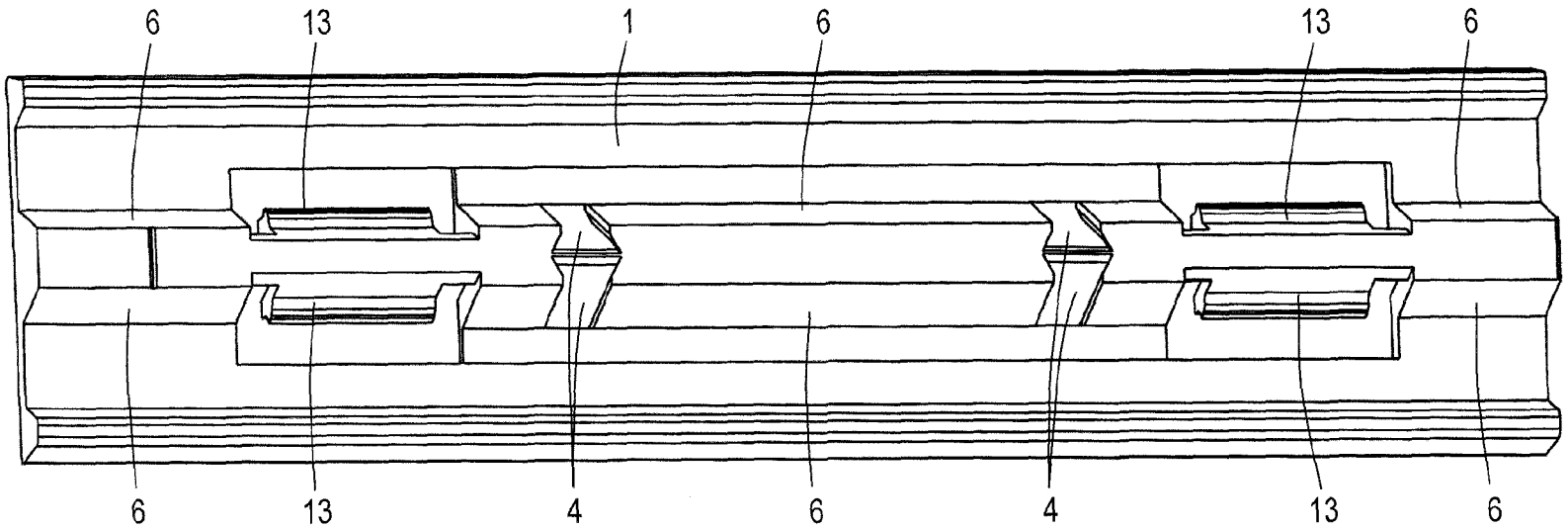
FIG. 1 is a perspective top view of a base coupling member of an embodiment of a panel coupling assembly.
Figure 2:
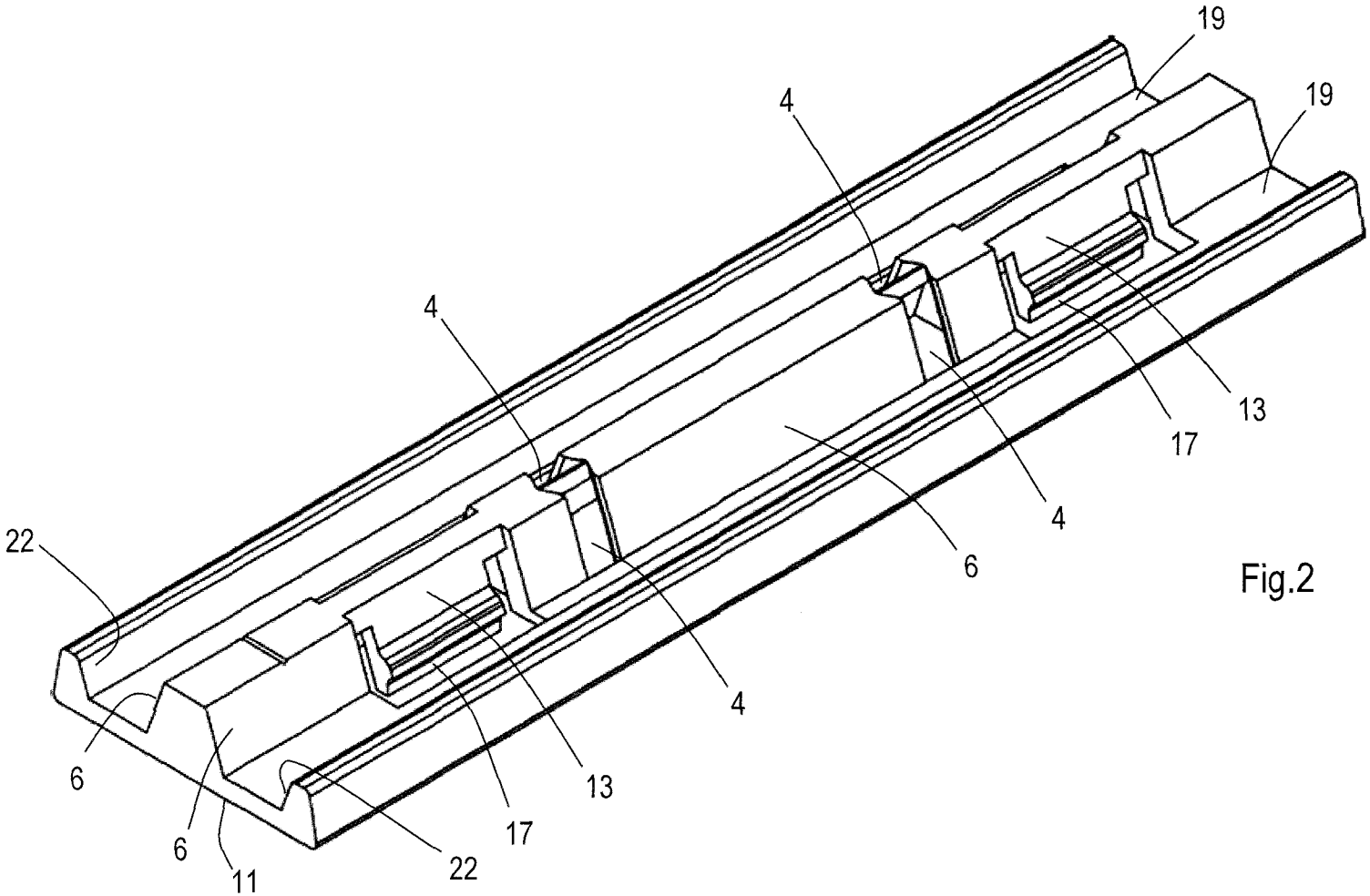
FIG. 2 is a similar view as FIG. 1 as seen from a different side.
Figure 3:
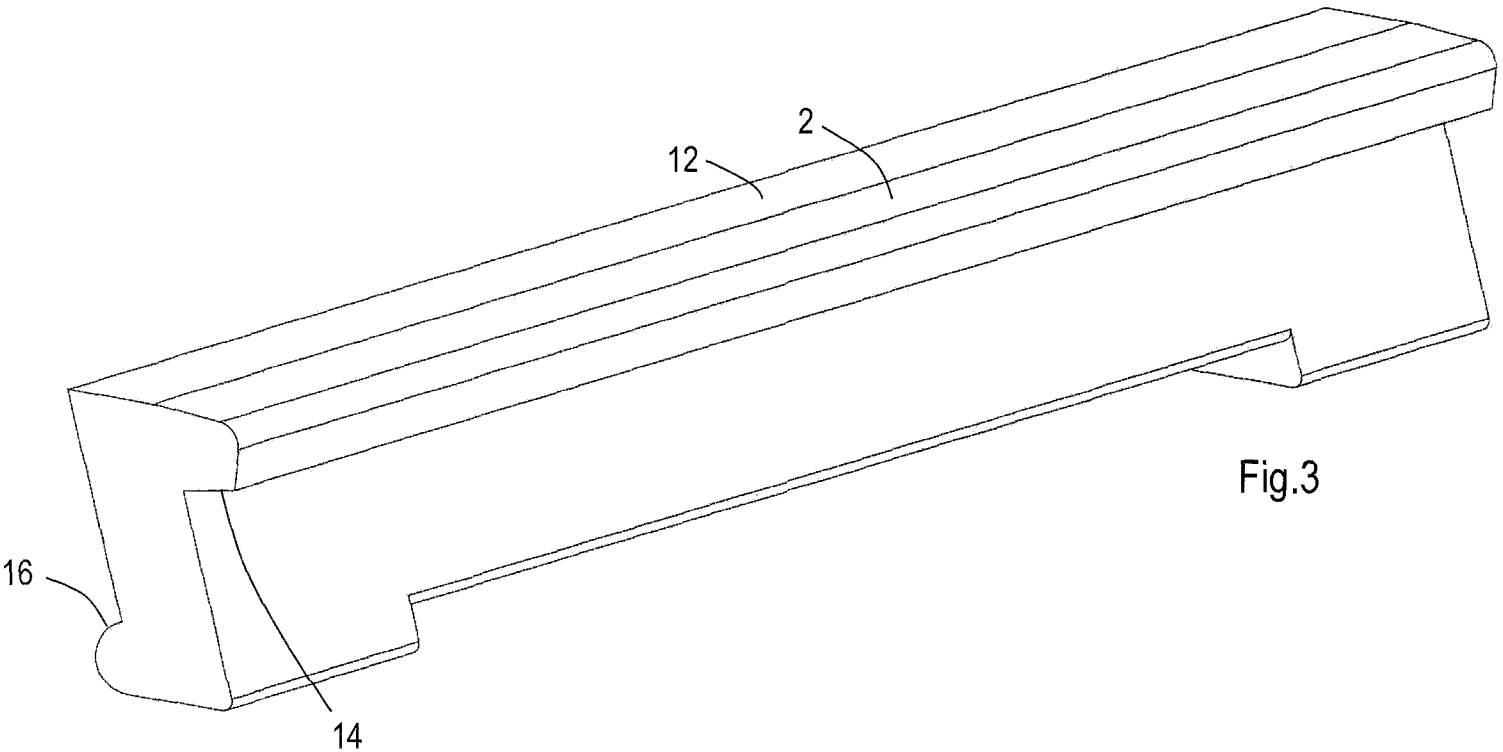
FIG. 3 is a perspective view of an intermediate coupling member of the embodiment of a panel coupling assembly.
Figure 4:
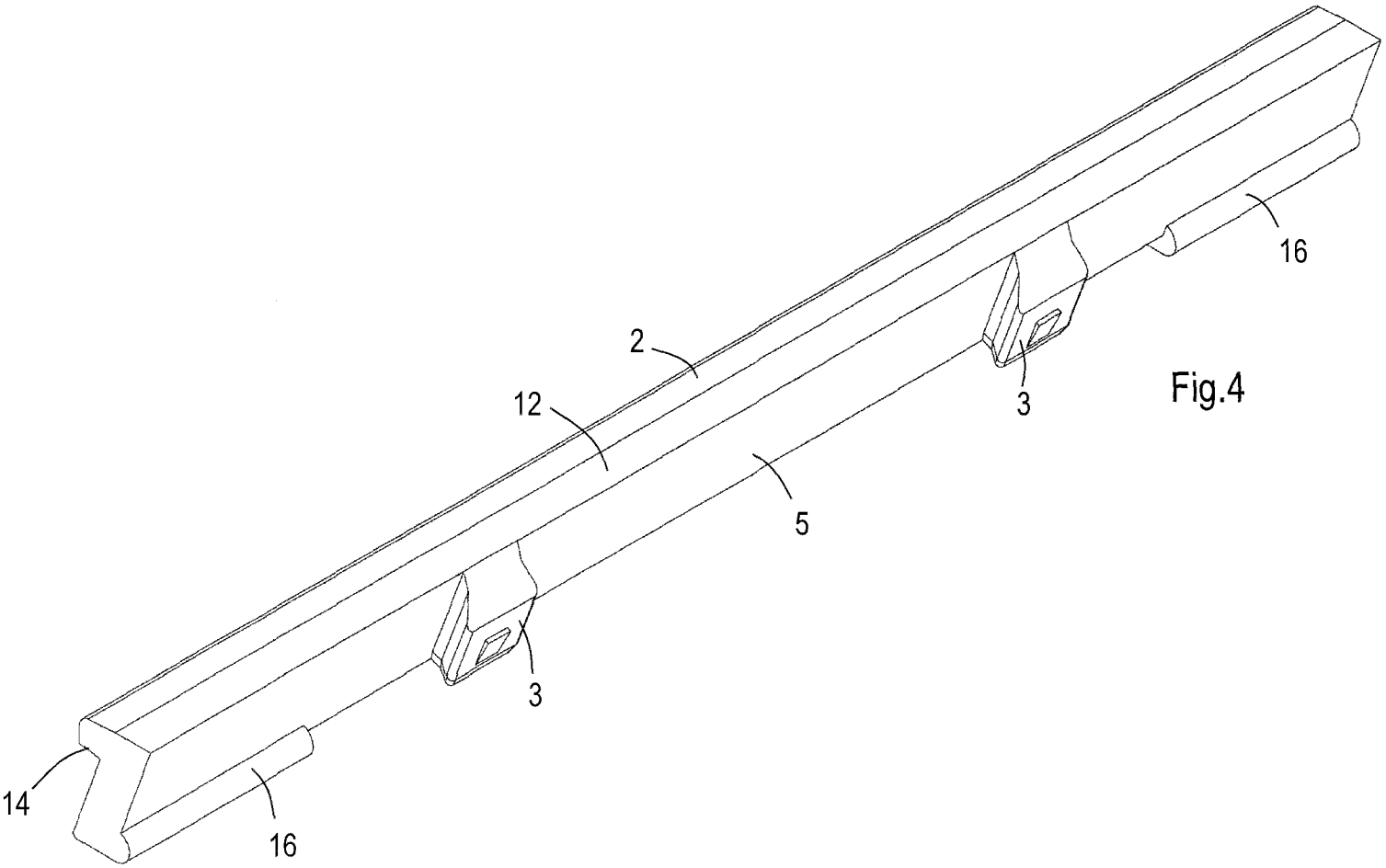
FIG. 4 is a similar view as FIG. 3 as seen from a different side.
Figure 5:
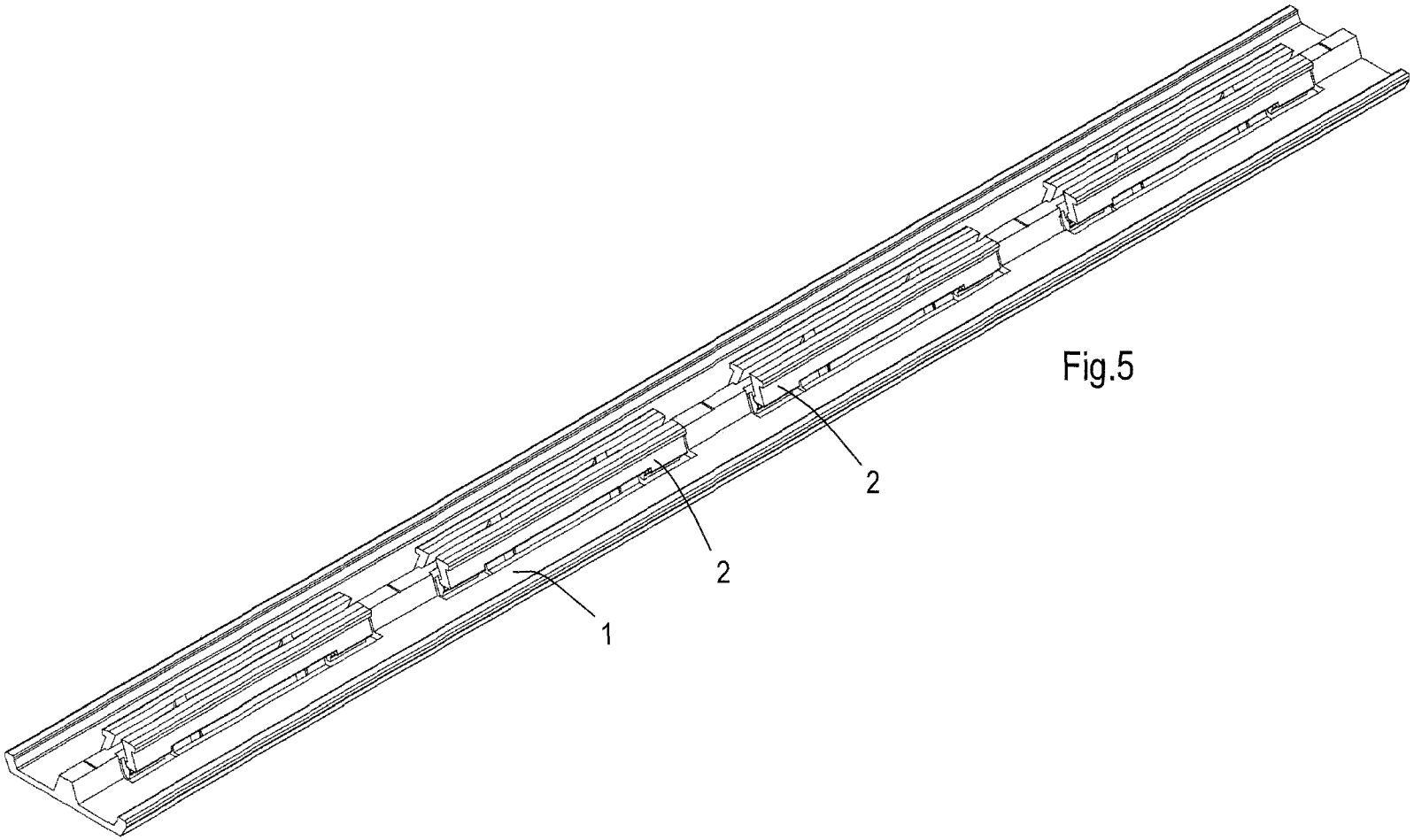
FIG. 5 is a similar view as FIG. 2, but illustrating the base coupling member to which several intermediate coupling members are coupled.

Separate parts of an embodiment of a panel coupling assembly are shown in perspective views in FIGS. 1-4. FIGS. 1 and 2 show a base coupling member 1 and FIGS. 3 and 4 show an intermediate coupling member 2. As shown in FIG. 4 the intermediate coupling member 2 is an elongated body which comprises extensions 3. The extensions 3 slidably fit in cavities 4 of the base coupling member 1 whereas a back side 5 of the intermediate coupling member 2 slidably fits to a guide 6. FIG. 5 illustrates a situation in which several intermediate coupling members 2 are slidably fit to the base coupling member 1. In this case the elongated bodies of the intermediate coupling members 2 are located behind each other in longitudinal direction thereof.

Figure 6:
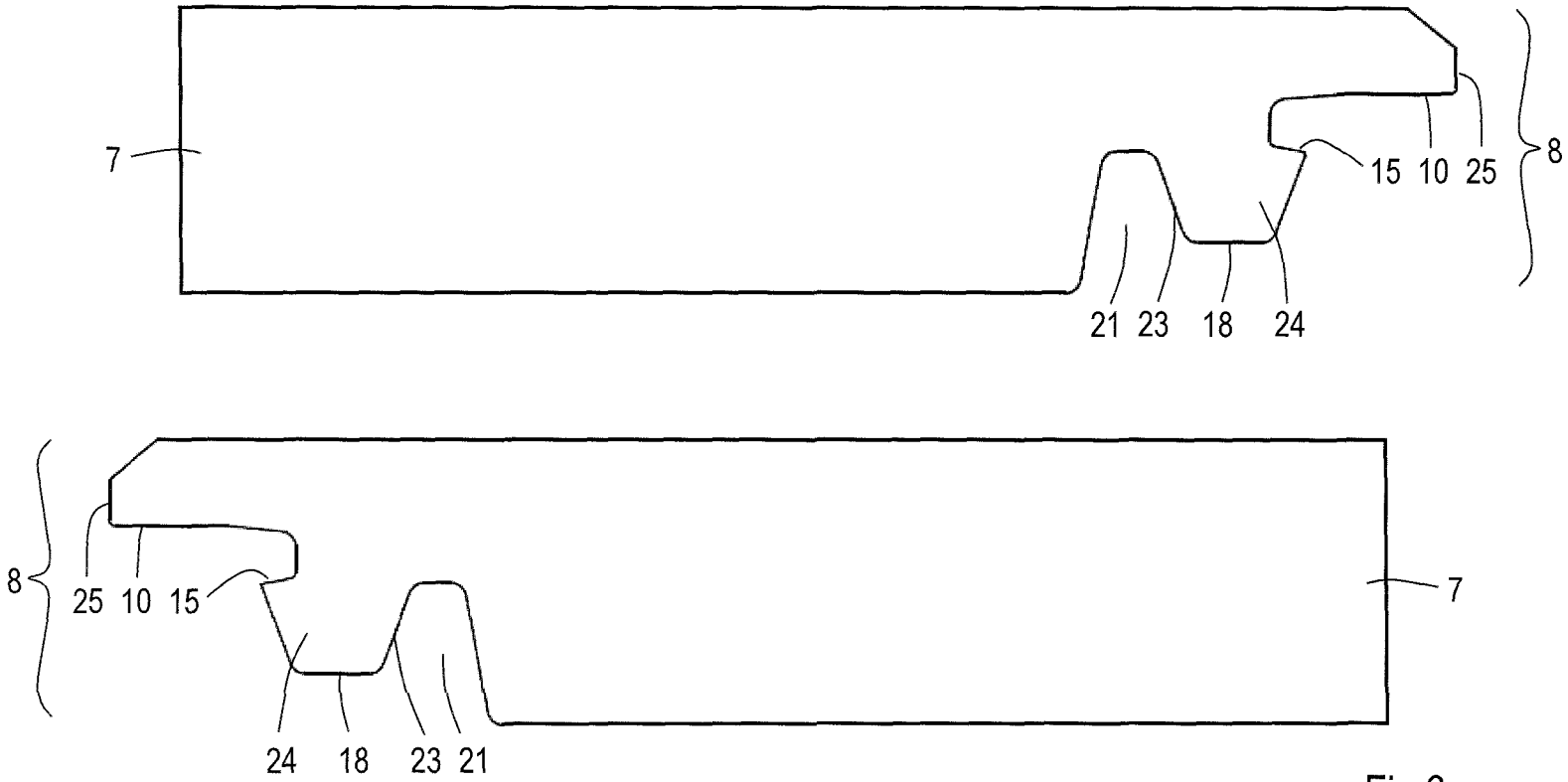
FIG. 6 is a cross-sectional view of adjacent panels of the embodiment of a panel coupling assembly.
Figure 7:
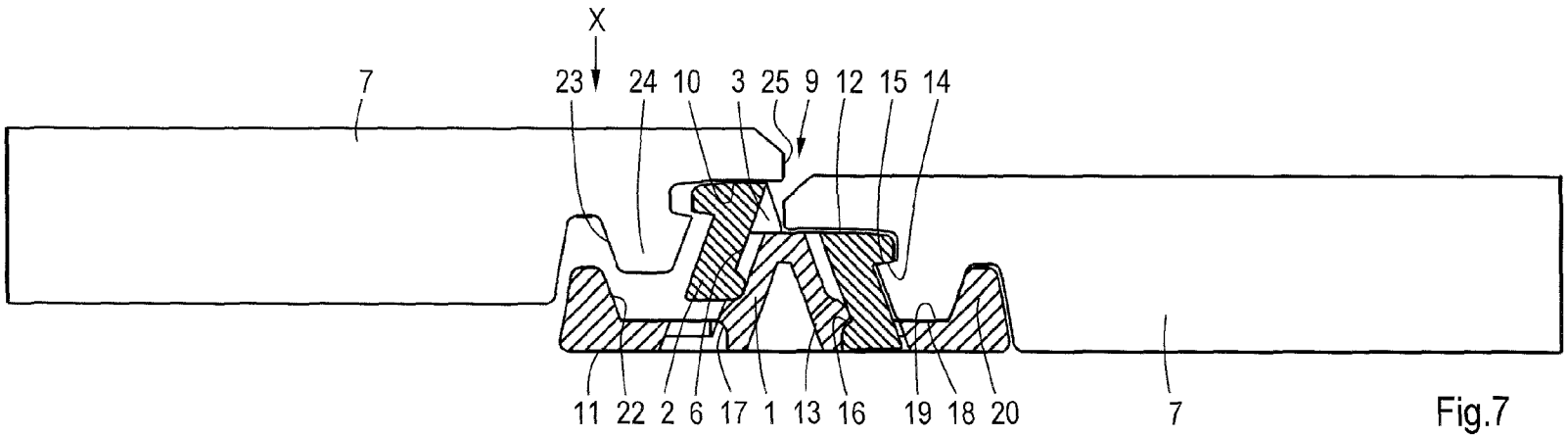
FIG. 7 is a similar view as FIG. 6 including the base coupling member and two intermediate coupling members in partly assembled condition.
Figure 8:
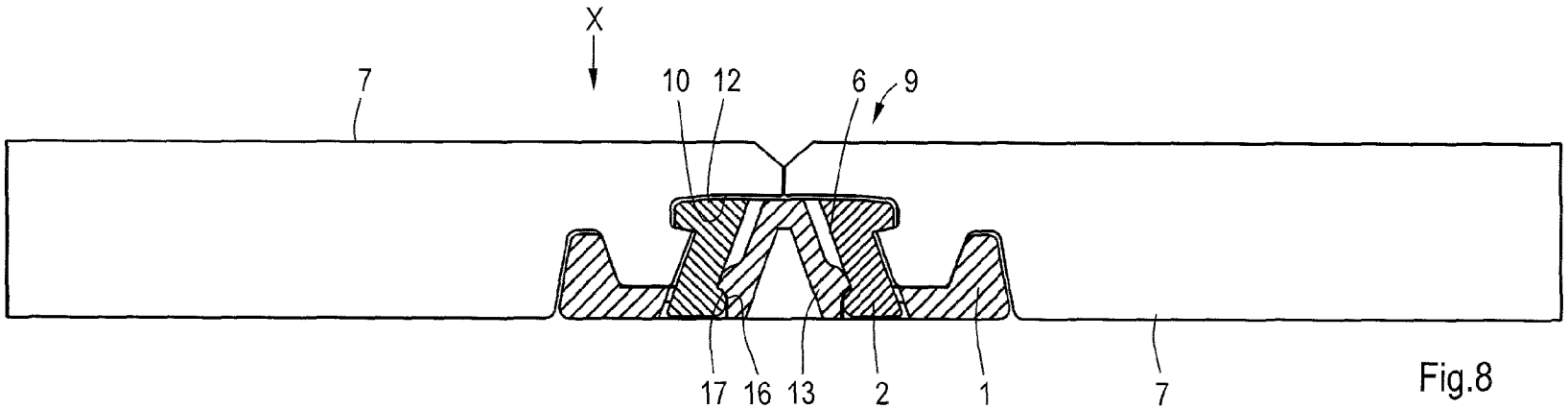
FIG. 8 is a similar view as FIG. 7 illustrating an entirely assembled condition.

FIG. 6 shows a cross-sectional view of two panels 7 which are part of the embodiment of the panel coupling assembly 9. The typical shapes of adjacent side edges 8 of the panels 7 will be clarified hereinafter. FIG. 7 illustrates the panel coupling assembly 9 in a non-assembled condition at the left side of the drawing and in an assembled condition at the right side of the drawing. In FIG. 8 an entirely assembled condition of both panels 7 is shown.

In fact the embodiment of the assembly 9 is formed by two base coupling members that are integrated in a single base coupling member 1 which can receive intermediate coupling members 2 at opposite sides thereof for fixing two adjacent panels 7 thereto. It is also possible that in an alternative embodiment the assembly comprises only a half of the base coupling member 1 accommodating a single intermediate coupling member 2 for fixing a single panel 7 thereto. Such an alternative embodiment can be used near a wall where the flooring ends.

The panels 7 have horizontally oriented grooves which are arranged parallel to their side edges 8. In practice the panels 7 may comprise a laminate of a core and at least a decorative upper layer.

Focussing in more detail on the embodiment of the panel coupling assembly 9 as shown in the figures, the side edge 8 of the panel 7 comprises an activating portion 10 which is directed to a panel fixing direction X, see FIG. 7. The panel fixing direction X is the direction in which the panel 7 is displaced with respect to the base coupling member 1 in order to attach the panel 7 to the base coupling member 1. In this case the base coupling member 1 is placed on the ground with a bottom side 11 thereof, whereas the fixing direction X is directed downwardly.

As illustrated in FIG. 7 the intermediate coupling member 2 is displaceable with respect to the panel 7 horizontally and the base coupling member 1 downwardly in the non-assembled condition. The intermediate coupling member 2 is provided with a sleeve portion 12 which faces the activating portion 10 of the panel 7. When the panel 7 is displaced downwardly the activating portion 10 presses onto the sleeve portion 12 which results in a downward displacement of the intermediate coupling member 2. Due to the orientation of the guide 6 the intermediate coupling member 2 is also displaced in horizontal direction and slides along an upper wall of the groove in the side edge 8, in this embodiment in a direction away from the base coupling member 1 towards the corresponding panel 7. As can be seen in FIG. 7 the guide 6 is angled with respect to an upper face of the panel 7. The guide angle can be 20-30° with respect to the upper face of the panel 7.

The panel coupling assembly 9 is also provided with a fixing element 13. In this embodiment the fixing element 13 comprises a resilient lip mounted to the base coupling member 1. The fixing element 13 is engageable to the intermediate coupling member 2. In the assembled condition as shown in the right part of FIG. 7 the intermediate coupling member 2 and the fixing element 13 together form a locking member 2, 13 that engages the panel 7 and the base coupling member 1 such that the panel 7 is locked with respect to the base coupling member 1 in a direction opposite to the panel fixing direction X. In other words the panel 7 is locked in upward direction with respect to the base coupling member 1 via the intermediate coupling member 2 and the fixing element 13.

In the assembled condition the intermediate coupling member 2 is engaged to the panel 7 at a location where a first intermediate coupling member contact portion 14 and a first panel contact portion 15 contact each other, whereas the fixing element 13 is engaged to the intermediate coupling member 2 at a location where a second intermediate coupling member contact portion 16 and a fixing element contact portion 17 contact each other. It is noted that in this case the sleeve portion 12, the first intermediate coupling member contact portion 14 and the second intermediate coupling member contact portion 16 are spaced from each other.

In the embodiment as shown in FIG. 7 the fixing element 13 and the intermediate coupling member 2 comprise a snap-in connection, which is formed by a resilient lip which is integral with the base coupling member 1. When the panel 7 is moved downwardly during assembling, the fixing element 13 is bent inwardly such that the intermediate coupling member 2 can displace further downwardly. When the intermediate coupling member 2 has passed a predefined position with respect to the fixing element 13, the fixing element 13 returns and moves outwardly such that it engages the intermediate coupling member 2. As shown in FIG. 7 both the intermediate coupling member 2 and the fixing element 13 are provided with cams to achieve this phenomenon. FIG. 7 also shows that the cams and other parts of the assembly 9 are shaped such that in the assembled or snapped condition the activating portion 10 of the panel 7 and the sleeve portion 12 of the intermediate coupling member 2 are free from each other. Due to the extensions 3 of the intermediate coupling member 2 which are received in cavities 4, the intermediate coupling member 2 is held to the guide 6 upon bending the cam of the fixing element 13 inwardly.

It is noted that the intermediate coupling member 2 has two tongues protruding in opposite horizontal directions. As described hereinbefore the tongues have associated functions. The upper one provides the first intermediate coupling member contact portion 14 at a lower side thereof for preventing the panel 7 from displacing upwardly with respect to the base coupling member 1, whereas the lower tongue provides the second intermediate coupling member contact portion 16 which hooks behind a cam of the fixing element 13 in order to prevent the intermediate coupling member 2 from displacing upwardly with respect to the base coupling member 1. The side edges 8 of the panels 7 are provided with a groove for receiving the upper tongue of the intermediate coupling member 2.

The outwardly protruding cam of the fixing element 13 is located such that in the non-assembled condition it supports the intermediate coupling member 2. The resiliency of the fixing element 13 is such that without exerting pressure onto the sleeve portion 12 the intermediate coupling member 2 is held in the position as illustrated in the left part of FIG. 7. This avoids the situation where the intermediate coupling member 2 moves downwardly too far such that the upper tongue thereof has already moved away from the base coupling member 1 towards the panel 7 before panel 7 is pressed onto the intermediate coupling member 2.

In the embodiment as shown in the figures, the first intermediate coupling member contact portion 14 and the first panel contact portion 15 are angled upwardly as seen in the horizontal direction in which the intermediate coupling member 2 is displaced during assembly. This provides a progressive down force onto the panel 7 upon assembling. Besides, the first intermediate coupling member contact portion 14 also provides a horizontal force on the panel 7.

The panel 7 is also locked in the panel fixing direction at a contact location between a second panel contact portion 18 that is directed in the panel fixing direction X and an associated base coupling member contact portion 19 that is directed in opposite direction of the panel fixing direction X. The second panel contact portion 18 and the base coupling member contact portion 19 may be flat or angled with respect to the upper face of the panel 7.

The base coupling member 1 is provided with an upwardly directed lip 20 which fits in a vertically oriented groove 21 of the panel 7. The lip 20 provides a lip contact portion 22 that is directed transversely with respect to the panel fixing direction X and which contacts a third panel contact portion 23. The first intermediate coupling member contact portion 14 and the lip contact portion 22 clamp a downwardly protruding panel lip 24 in horizontal direction. The third panel contact portion 23 may be angled at 55-65° with respect to the upper face of the panel 7.

Alternatively, clamping of the panel 7 in horizontal direction can also be achieved by the lip contact portion 22 and an upper side edge portion 25 of an adjacent panel 7. This is advantageous in terms of closing any gaps between the upper side edge portions 25 of adjacent panels 7, hence minimizing any penetration of dirt or moisture between the panels 7.

It is noted that the panel 7 and the intermediate coupling member 2 are displaceable with respect to each other in a direction extending transversely with respect to the fixing direction X in the non-assembled condition. This is shown in FIG. 7 in which it can be seen that the left panel is displaceable horizontally with respect to the intermediate coupling member 2 and the base coupling member 1. For example, during the downward movement of the panel 7 the third panel contact portion 23 may be guided along the lip contact portion 22, hence being displaced in horizontal direction, as well.

It is conceivable that during the manufacturing process of parts of the panel coupling assembly 9 the intermediate coupling members 2 are already fit in the base coupling member 1. It is also possible that one panel 7 is already attached to the base coupling member 1, whereas only the other one has to be attached upon laying the flooring.

The dimensions and orientations of the different parts as described above can be selected such that detaching the panel 7 from the base coupling member 1 is possible by exerting an upward force on the panel 7. If all sides of one panel are formed like the embodiment of FIG. 7 and corresponding base coupling members 1 and intermediate coupling members 2 are present, the panel 7 can be taken out a flooring separately, i.e. without detaching adjacent panels 7.

The panels 7 may have different shapes, for example rectangular, square or the like. The side edges 8 as shown in the figures may be present at one or more sides of the panel 7. If the shape of the side edge 8 is present at the entire circumference of the panel 7 and the panel 7 is entirely attachable to the base coupling member 1, it can be attached or detached in the middle of a flooring.

Figure 9A:
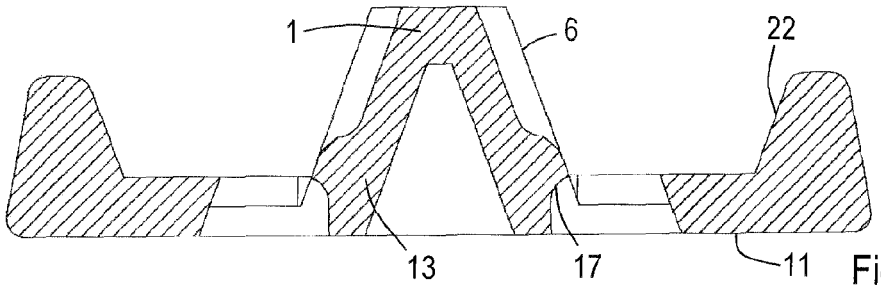
FIG. 9 is a series of different cross-sectional views illustrating different positions of the intermediate coupling members with respect to the base coupling member.
Figure 9B:
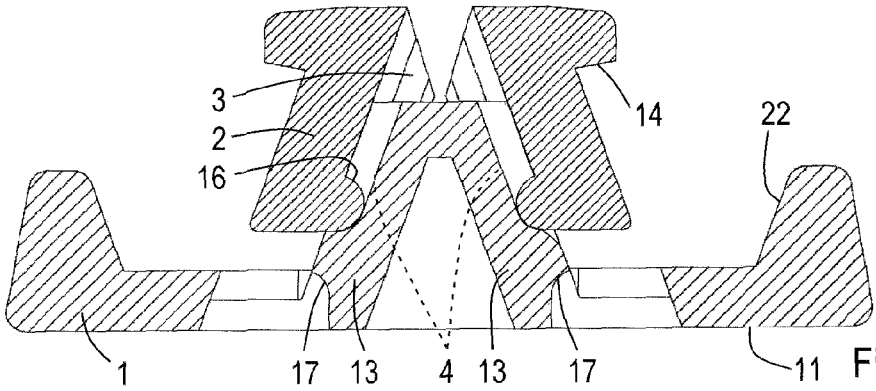
Figure 9C:
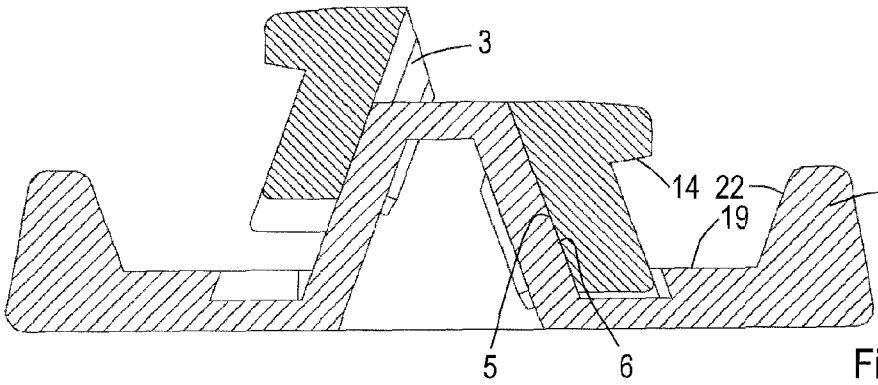
Figure 9D:
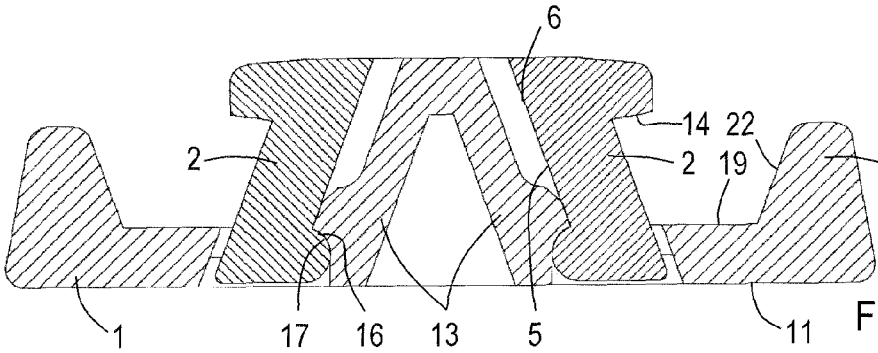

FIG. 9*a* shows a cross-sectional view of the base coupling member 1 including the reference signs that indicate relevant portions of the base coupling member 1 as described hereinbefore. FIG. 9*b* shows a view at the same longitudinal location as FIG. 9*a* of the base coupling member 1 including two intermediate coupling members 2. In this situation the lower tongues of the intermediate coupling members 2 rest on the outwardly protruding cams of the fixing elements 13. The extensions 3 are accommodated in the cavities 4. FIG. 9*d* shows the situation in which the lower tongues of the intermediate coupling members 2 are hooked behind the cams of the fixing elements 13. FIG. 9*c* shows a view at a different longitudinal location than that shown in FIGS. 9*a* and 9*b* in order to illustrate that the back side 5 of the intermediate coupling member 5 slides along the guide 6.

The invention is not limited to the embodiments shown in the figures, which can be varied in several ways within the scope of the invention. It is for example possible that the guide is configured such that the intermediate coupling member is displaced in the direction of the base coupling member during assembly and engages thereto in the assembled condition, whereas the fixing element locks the intermediate coupling member with respect to the panel.

The invention claimed is:

1. A panel coupling assembly comprising:

a panel including a side edge which is provided with an activating portion directed to a panel fixing direction, a base coupling member, an intermediate coupling member being displaceable with respect to the panel and the base coupling member in a non-assembled condition and which is provided with a sleeve portion facing the activating portion of the panel, a guide configured to guide the intermediate coupling member from a position in the non-assembled condition to a position in an assembled condition of the panel coupling assembly, which guide is configured such that upon displacing the panel with respect to the base coupling member in the panel fixing direction the activating portion of the panel presses onto the sleeve portion and the intermediate coupling member is displaced in at least a direction extending transversely to the panel fixing direction, a fixing element being engageable to the intermediate coupling member such that in the assembled condition the intermediate coupling member and the fixing element together form a locking member that couples the panel and the base coupling member such that the panel is locked with respect to the base coupling member in a direction opposite to the panel fixing direction.

2. The panel coupling assembly according to claim 1, wherein the intermediate coupling member is engaged to the panel, and the fixing element is engaged to the base coupling member in the assembled condition.

3. The panel coupling assembly according to claim 1, wherein the assembly is configured such that upon displacing the panel with respect to the base coupling member in the panel fixing direction the intermediate coupling member is at least displaced in the fixing direction.

4. The panel coupling assembly according to claim 3, wherein the snap-in connection is formed by a resilient lip at the base coupling member which engages a cam on the intermediate coupling member.

5. The panel coupling assembly according to claim 1, wherein the fixing element and the intermediate coupling member comprise a snap-in connection which is activated by displacing the panel with respect to the base coupling member beyond a predefined position.

6. The panel coupling assembly according to claim 1, wherein the assembly is configured such that the activating portion of the panel and the sleeve portion of the intermediate coupling member are substantially free from each other in the assembled condition.

7. The panel coupling assembly according to claim 1, wherein the base coupling member is located on the ground and the panel fixing direction is directed downwardly.

8. The panel coupling assembly according to claim 1, wherein the guide is provided at the base coupling member for guiding the intermediate coupling member with respect thereto.

9. The panel coupling assembly according to claim 1, wherein the guide is angled with respect to an upper face of the panel in the assembled condition.

10. The panel coupling assembly according to claim 9, wherein the angle lies between 60 and 80 degrees.

11. The panel coupling assembly according to claim 1, wherein the guide is provided with a guide coupling which is configured such that the intermediate coupling member is moveable with respect to the base coupling member in only one dimension.

12. The panel coupling assembly according to claim 1, wherein the intermediate coupling member is provided with a tongue extending in a direction transversely with respect to the panel fixing direction and the side edge of the panel is provided with a groove for receiving the tongue, wherein a lower portion of the tongue forms a first intermediate coupling member contact portion which engages a first panel contact portion being a bottom portion of said groove.

13. The panel coupling assembly according to claim 12, wherein the first intermediate coupling member contact portion and the first panel contact portion are angled with respect to an upper face of the panel.

14. The panel coupling assembly according to claim 1, wherein the assembly comprises two integrated base coupling members, two intermediate coupling members and two panels for attaching two adjacent panels to said integrated base coupling members.

15. The panel coupling assembly according to claim 1, wherein the intermediate coupling member is a separate element.

* * * * *